US006244826B1

(12) United States Patent
Sarathi

(10) Patent No.: US 6,244,826 B1
(45) Date of Patent: Jun. 12, 2001

(54) GASEOUS PISTON METHOD FOR SUCTION AND COMPRESSION IN CLOSED CHAMBER GAS EQUIPMENTS

(76) Inventor: T. R. Sarathi, Door No 2014, Sumathy Flats, New Boag Road, Madras, 600 017 (IN)

( * ) Notice: Subject to any disclaimer, the term of this patent is extended or adjusted under 35 U.S.C. 154(b) by 0 days.

(21) Appl. No.: 08/540,495

(22) Filed: Oct. 10, 1995

(51) Int. Cl.[7] ..... F04F 1/02
(52) U.S. Cl. ..... 417/54; 417/65; 417/187
(58) Field of Search ..... 417/65, 149, 151, 417/153, 118, 120, 121, 87, 53, 54; 137/888, 892

(56) References Cited

U.S. PATENT DOCUMENTS

| | | | | |
|---|---|---|---|---|
| 585,434 | | 6/1897 | Gibbon . | |
| 1,733,431 | | 10/1929 | Sherman . | |
| 2,226,539 | * | 12/1940 | Wydler | 417/65 |
| 2,446,094 | | 7/1948 | Mattice . | |
| 2,630,249 | * | 3/1953 | Bryant et al. | 417/118 |
| 2,853,987 | | 9/1958 | Berchtold et al. . | |
| 3,082,934 | * | 3/1963 | Spalding | 417/64 |
| 3,084,511 | * | 4/1963 | Klapproth | 417/64 |
| 3,164,320 | * | 1/1965 | Welbourn | 417/65 |
| 3,449,913 | * | 6/1969 | Grebe | 60/204 |
| 3,695,238 | | 10/1972 | Boerma . | |
| 3,861,830 | * | 1/1975 | Johnson | 417/149 |
| 4,239,054 | * | 12/1980 | Van Rijn | 417/118 |
| 4,272,223 | * | 6/1981 | Bauer | 417/65 X |
| 4,354,805 | * | 10/1982 | Bauer | 417/65 X |
| 5,156,814 | * | 10/1992 | Fielden et al. | 417/118 |
| 5,873,240 | * | 2/1999 | Bussing et al. | 60/207 |
| 5,901,550 | * | 5/1999 | Bussing et al. | 60/39.38 |

FOREIGN PATENT DOCUMENTS

| | | | | |
|---|---|---|---|---|
| 299420 | * | 10/1928 | (GB) | 417/65 |
| 324598 | * | 1/1930 | (GB) | 417/65 |

* cited by examiner

*Primary Examiner*—Charles G. Freay
(74) *Attorney, Agent, or Firm*—Jones & Askew, LLP

(57) ABSTRACT

A method for conducting suction and compression operation on a gaseous medium of thermodynamic process in the closed chamber of a closed chamber gas equipment said suction operation intended to bring the gaseous medium in to the closed chamber and said compression operation intended to compress the gaseous medium retained within the closed chamber;

The gaseous medium is exposed to have direct contact with a gas which is dissimilar in composition to that of said gaseous medium and which is moving away from and towards the gaseous medium with the aid of a gas discharge means performing respectively the suction and compression operation and thereby acting as a gaseous piston.

The gaseous piston may do only one of the two operations namely suction or compression.

The gas discharge means may comprise a venturi means connected to the closed chamber or a gas reservoir connected to the closed chamber or both.

The admittance of gaseous piston in to and out of the closed chamber may be through valve or port means.

The gaseous piston may work along with a solid piston in such a way that one of the pistons is doing suction operation and the other is doing compression operation.

13 Claims, 12 Drawing Sheets

FIG. 3
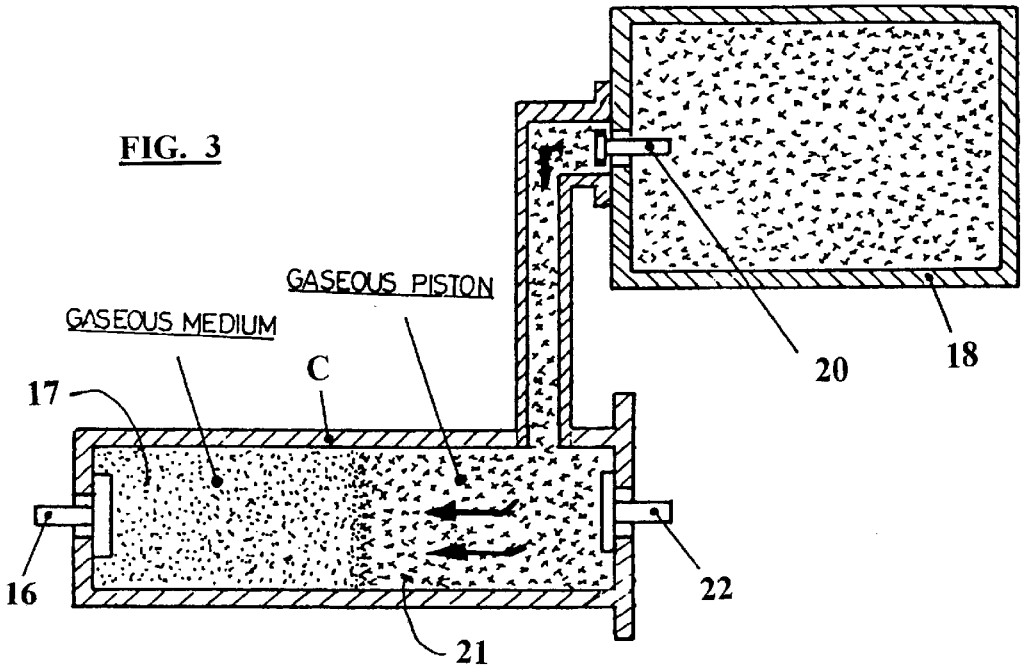
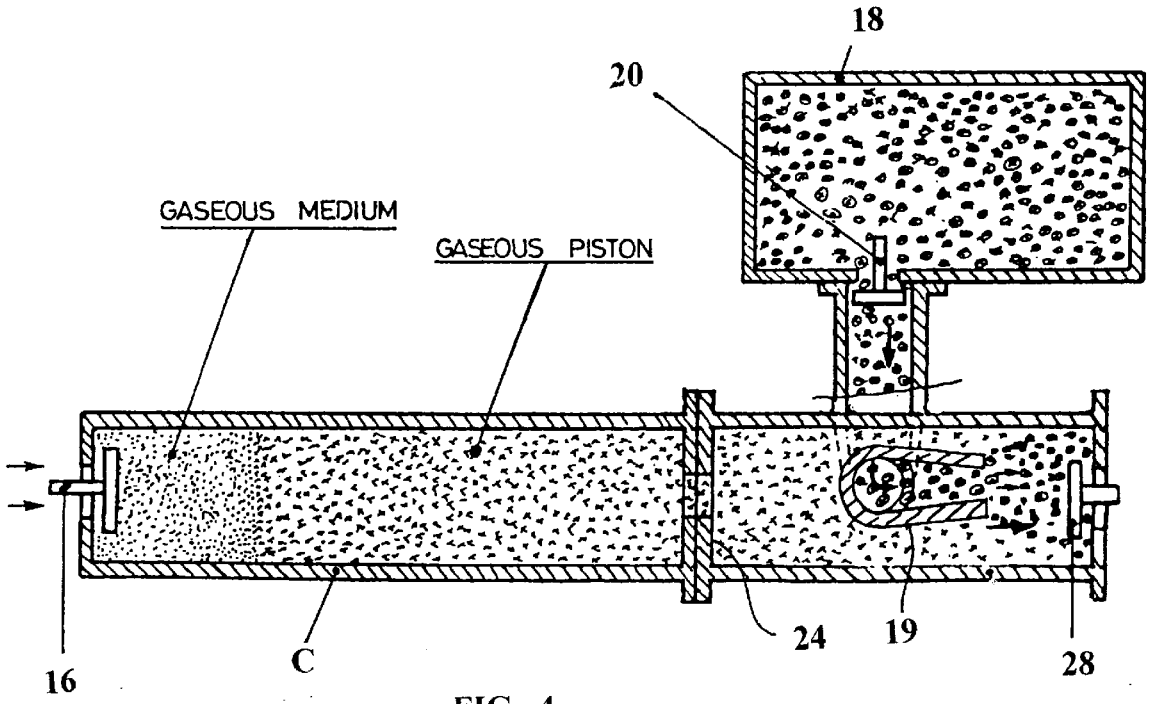
FIG. 4

FIG. 5
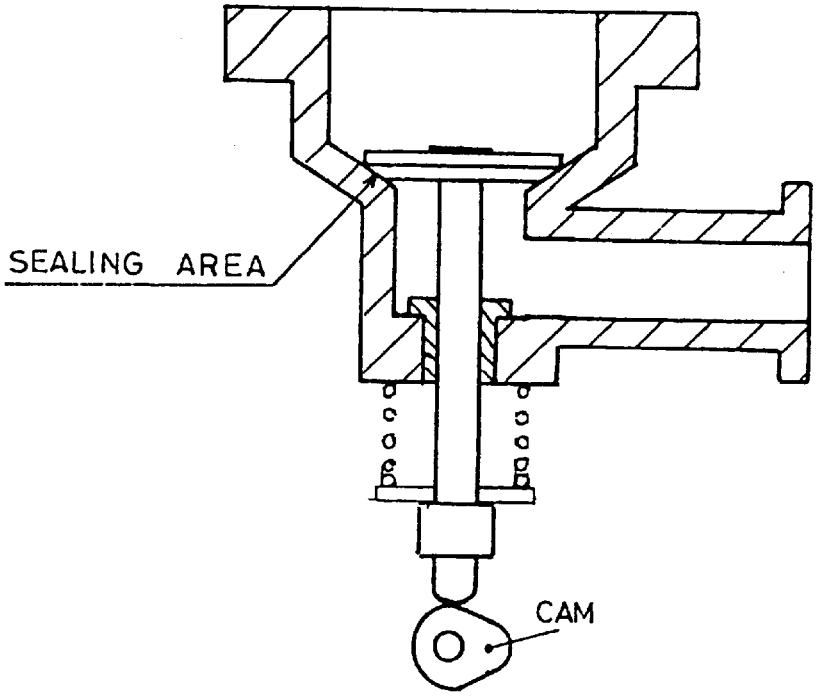
FIG. 6A
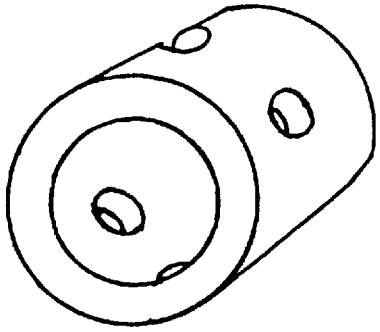
BODY
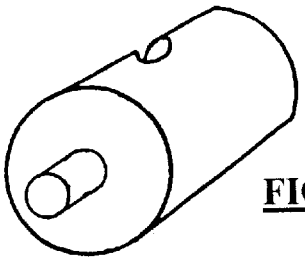
FIG. 6B
SHAFT
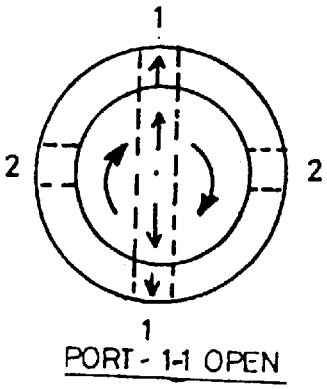
PORT - 1-1 OPEN
FIG. 6C
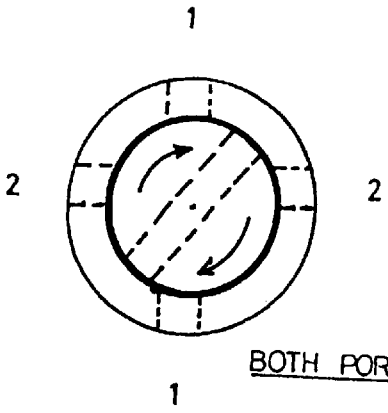
BOTH PORTS CLOSED
FIG. 6D FIG. 6E
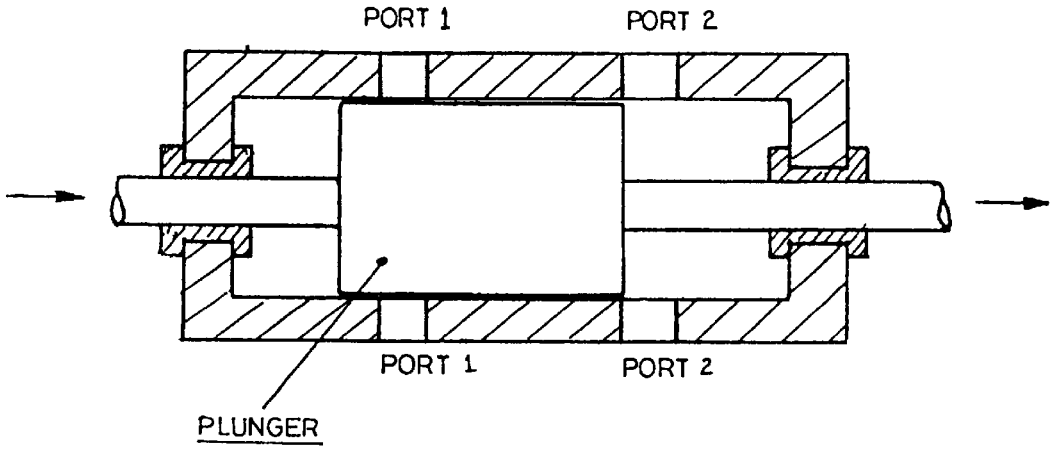
FIG. 7A
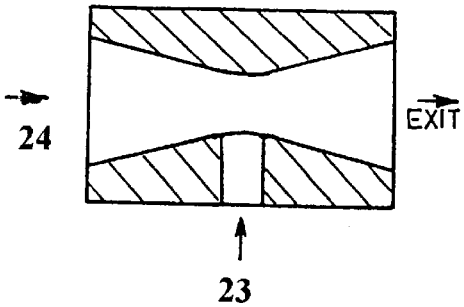
FIG. 7B
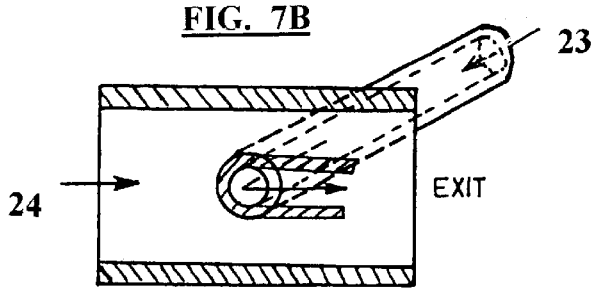
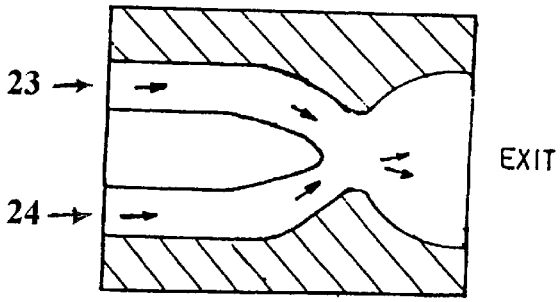
FIG. 7C FIG. 8A
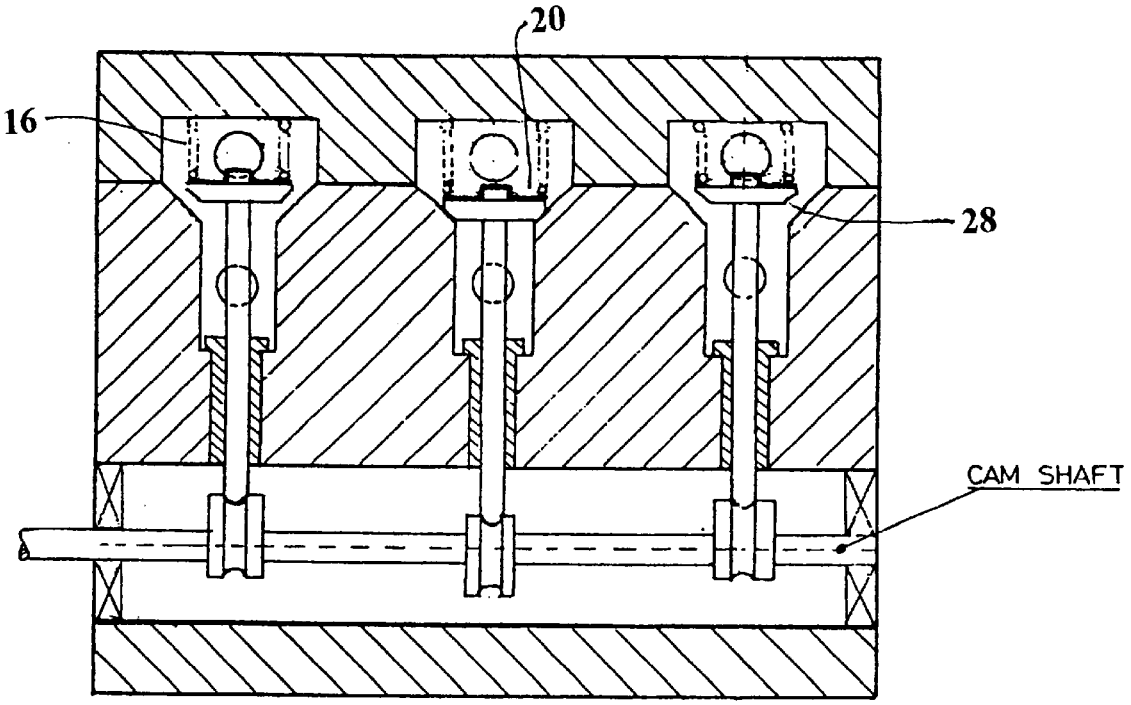
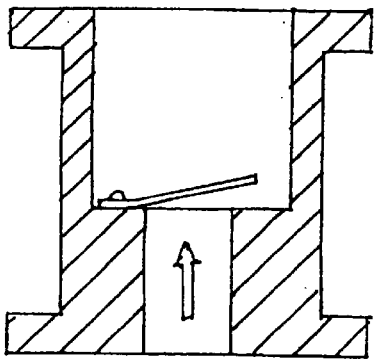
FIG. 8B
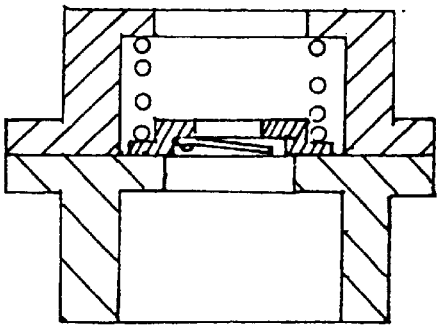
FIG. 8C

GASEOUS PISTON METHOD FOR SUCTION AND COMPRESSION IN CLOSED CHAMBER GAS EQUIPMENTS

FIELD OF THE INVENTION

This invention is related to methods and apparatus for using a first gas to compress or suction out a second gas.

BACKGROUND OF THE INVENTION

Present day four-stroke internal combustion (IC) engines employ a solid piston moving to and fro inside a cylindrical bore, to perform the four operations, viz., (i) suction, (ii) compression, (iii) power and (iv) exhaust. The present day two-stroke IC engines do the first three of the above four operations by solid piston only, the only difference being in that the crankcase side of the piston is used for an intake or suction operation, so that while the solid piston is doing compression on one side it is doing suction on the other side.

The fourth operation, viz., the exhaust, done in present-day 2-stroke IC engines, may be viewed with interest to compare with the present invention in the sense that two dissimilar gases in direct contact result in filling the closed chamber with gaseous medium. Though the above exhaust process may also be called as partial gaseous piston method, the present invention differs fundamentally in the method and purpose, the details and the novelty of which have been given below.

More generally, present-day reciprocating air-compressors employ a solid piston moving inside a cylindrical bore to perform suction and compression alternatively. However, a solid piston reciprocating in a closed chamber presents various problems of cost and inefficiency. Bore and piston have to be precisely machined and sealing rings are necessary for effective sealing, and loss of power due to friction is high because of the sliding piston. A heavy lubrication system is required for the sliding piston, and a heavy cooling system is necessary because the piston will seize if the equipment runs at elevated temperatures. Because of the heavy cooling system, loss of heat energy in cooling water or air is high. Wear and tear of bore and piston necessitates frequent maintenance or replacement of parts like the sleeve, piston rings, etc. Vibration (due to unbalanced reciprocating mass) and noise are high.

Limitations of existing solid-piston IC engines also are known. Because the stroke and the clearance volume are fixed, the compression ratio of the engine is fixed. In other words, the suction and compression pressures are almost fixed for a given speed of the engine. Because of the above points, an engine designed for a specific fuel, e.g. gasoline, cannot be easily altered for other fuels like diesel or LPG (Liquid Petroleum Gas).

The power of a solid-piston IC engine is dependent on the speed to a great extent. In fact, while the actual requirement in most of the applications is high-torque at low speed and lower-torque at high speed, the IC engine delivers power the other way. Moreover, the engine is capable of delivering power only within a specified range of RPM; there is an idling speed and a maximum speed. It cannot deliver power at zero RPM like a steam engine. In order to be ready for delivering power, the engine has to run at idling speed, wasting fuel.

The solid-piston engine gives acceptable performance (both fuel economy-wise as well as torque capacity-wise) only within a narrow bandwidth of the engine speed. This fact necessitates accessories like a clutch and gear system to obtain the same power at low as well as high output speeds, at the wheels of the vehicle. Moreover, the engine starting apparatus is heavy and quite costly due to high frictional torque and the high idling speed. The ignition timing, the rate of combustion, and the velocity and position of pistons must be coordinated failing which, problems like pre-ignition, knocking, etc., arise.

DESCRIPTION OF RELATED ART

Relevant prior art includes U.S. Pat. No. 585,434 titled "Explosive Engine", which uses a compressed air-fuel mixture in the crank case to push (positive pressure) the burnt gases out of the combustion chamber. The present invention is the opposite, i.e., a flowing gas which may be burnt gas itself sucks (negative pressure) the air-fuel mixture into the combustion chamber. In the present invention the air-fuel mixture (which is the gaseous medium of a thermodynamic cycle) is the passive gas, and the burnt gas (gaseous piston) is the active gas, during scavenging. In the above patent, it is the other way, i.e., the air-fuel mixture is the active gas while the burnt gas is the passive gas. In other words, the present invention is about a method to perform suction or compression wholly on the medium of thermodynamic process.

In the above patent, the air-fuel mixture, which is the medium of thermodynamic process, does not undergo suction or compression by another gas. Instead, it undergoes suction first in the crankcase, then compression in the crankcase, and then compression once again in the cylinder, all the time done by the solid piston only. Also, regarding the burnt gas present in the cylinder during scavenging it has already undergone and completed the three thermodynamic processes, viz., compression, heat addition, and expansion, and is now a product of waste which just has to be removed. A substantial portion of the burnt gas has already left, due to advanced valve or port opening, which leaves only a fraction of the mass of original gas taken for the cycle.

The definition of closed chamber gas equipment calls for a fixed mass of gaseous medium throughout the thermodynamic cycle. Here, the mass of burnt gas is reduced from that involved in the cycle. Hence the burnt gases can no longer be called as gaseous medium of the thermodynamic process. The process of scavenging the burnt gas is not done wholly but done in part, since part of the burnt gas leaves by itself out of the cylinder as mentioned above.

U.S Pat. No. 3,695,238 tided "IC Engine Exhaust Gas Discharge System" uses an exhaust receiver connecting the exhaust ports of two cylinders and uses wave reflections to enhance the compression and exhaust operations to increase the engine efficiency. The exhaust gas does not perform wholly any one of the compression or exhaust operations but merely enhances the said operations done by solid piston method.

U.S. Pat. No. 1,733,431 titled "Internal Combustion Engine" solves the problem of condensation of fuel in the crankcase of a two-stroke engine by admitting air compressed in the crankcase through the carburetor to the combustion chamber, and also increases the pressure at the suction stroke to superatmospheric pressure. Hence, even though this method delivers superatmospheric pressure gas to the combustion chamber to increase the compression pressure of the engine, this method does not by itself replace the solid piston by an element to do the compression operation.

The same can be said of any prior turbo-charged or supercharged engines such as shown in U.S. Pat. No. 2,853, 987 titled "Diesel Engine Supercharged By The Aero-Dynamic Wave Machine", where direct exchange of energy between intake gas and burnt gas is disclosed but only to increase the suction pressure and not to replace the solid piston for the suction process.

U.S. Pat. No. 2,446,094 titled "Supercharging and Scavenging IC Engines" discloses pairs of tubes generating jets of gases but again, not to replace the solid piston in the suction and compression processes but only to assist the solid piston further in the said operations.

A Sterling-liquid piston engine used liquid colum in U-tubes as a substitute for solid piston. Though that engine has technical and commercial problems, it proved that solid is not the only form for making pistons.

OBJECTS OF THE INVENTION

The objects of the present invention are to provide an improved method and apparatus for compressing a gaseous medium.

More particularly, other objects of the present invention are:

- to reduce or remove the problems arising out of solid piston method in the aspects of cost, maintenance, nuisance, efficiency and weight as stated herein;
- to counter some of the limitations arising in the existing IC engines as described above;
- to eliminate one or more of the parts of an automobile like the clutch and gear system, starting motor etc., and benefit on cost, maintenance, weight, etc., as described above;
- to separate out the power unit of an IC engine from suction, compression, and combustion units so as to facilitate variable mode of power output, viz., jet, turbine, gas motors, from the same closed chamber combustion unit;
- to facilitate storage of high pressure burnt gas as an alternative mode of energy derived from a closed chamber combustion engine; and
- to make closed chamber gas equipment, like IC engines, reciprocating compressors, etc., without any solid internal moving parts like pistons or rotors.

SUMMARY OF THE INVENTION

Stated in general terms, the present invention is a new method called gaseous piston method for conducting suction and compression operations on the gaseous medium undergoing thermodynamic process, and apparatus for producing that method.

"Closed Chamber Gas Equipment", as used herein, means non-flow system equipment like internal combustion engines, reciprocating air-compressors, etc., which take a specific mass of gaseous medium into a closed chamber and perform thermodynamic processes on the gaseous medium before taking a next mass of gas. By definition in closed chamber gas equipment, the mass of gas taken per cycle remains unchanged throughout the thermodynamic cycle involved.

Closed chamber gas equipment, in which the flow of gas is intermittent, employs a solid piston (usually made of steel or aluminum) moving inside a cylinder to perform the gas cycles in the closed chamber, namely, the cylinder. Since the present invention is about closed chamber and intermittent or non-flow equipment, open chamber or continuous flow equipment like turbines, present-day jet engines, centrifugal compressors, etc., are not comparable with that invention.

BRIEF DESCRIPTION OF THE DRAWINGS

FIG. 3 shows a method and apparatus to generate gaseous piston for compression;

FIG. 4 shows a method and apparatus to generate gaseous piston for both suction and compression in same closed chamber;

FIG. 5 shows typical valve and cam actuation;

FIGS. 6A and 6B respectively show typical longitudinal and radial ports;

FIG. 7 shows various types of venturi means;

FIG. 8A shows a typical valve unit assembly;

FIG. 8B shows a typical reed valve assembly;

FIG. 8C shows a typical pressure trap valve;

DETAILED DESCRIPTION OF THE PREFERRED EMBODIMENTS

The terms suction and compression are used in the same sense as is meant by the conventional sequential strokes of internal combustion engines namely, (i) suction, (ii) compression, (iii) power, and (iv) exhaust.

The suction operation is intended for filling up the closed chamber of the equipment with the gaseous medium concerned for subsequent thermodynamic processes.

The compression operation is the compression work done on the gaseous medium which is retained within the closed chamber till the desired increase in pressure is achieved, the process forming part of thermodynamic cycle undergone by the gaseous medium.

The present invention uses the gaseous piston to replace the solid piston for doing only the suction operation and the compression operation. Those two operations, viz., suction and compression, are independent of each other and the user may adopt the gaseous piston method for any one or both of the two operations.

The combustion chamber of present day IC engines and the compression chamber of present day reciprocating air-compressors are particular examples of closed chambers, being cylindrical in order to make effective sealing with the solid piston in the simplest form. The typical closed chamber is a thick walled vessel preferably of steel or aluminum or their alloys inside which the thermodynamic gas process is performed. The restrictions in the geometry of these closed chambers, namely, (i) only cylindrical and (ii) the ratio of length by cross section (L/D ratio) close to 1.0, are removed if gaseous piston is used instead of solid piston, for all the processes in the closed chamber. Where all the thermodynamic processes in a closed chamber are done by gaseous piston, the L/D ratio of the closed chamber is preferred to be high enough to minimize mixing of flowing gas with gaseous medium and not too high to cause excessive pipe friction hindering the equipment's performance. In fact, the shape of the chamber can be varied from simple cylinder or conical structure to any complex stream-lined bore to get the optimum results. This advantage of variable geometry of closed chamber is not possible if solid piston is used.

Figure 12A:
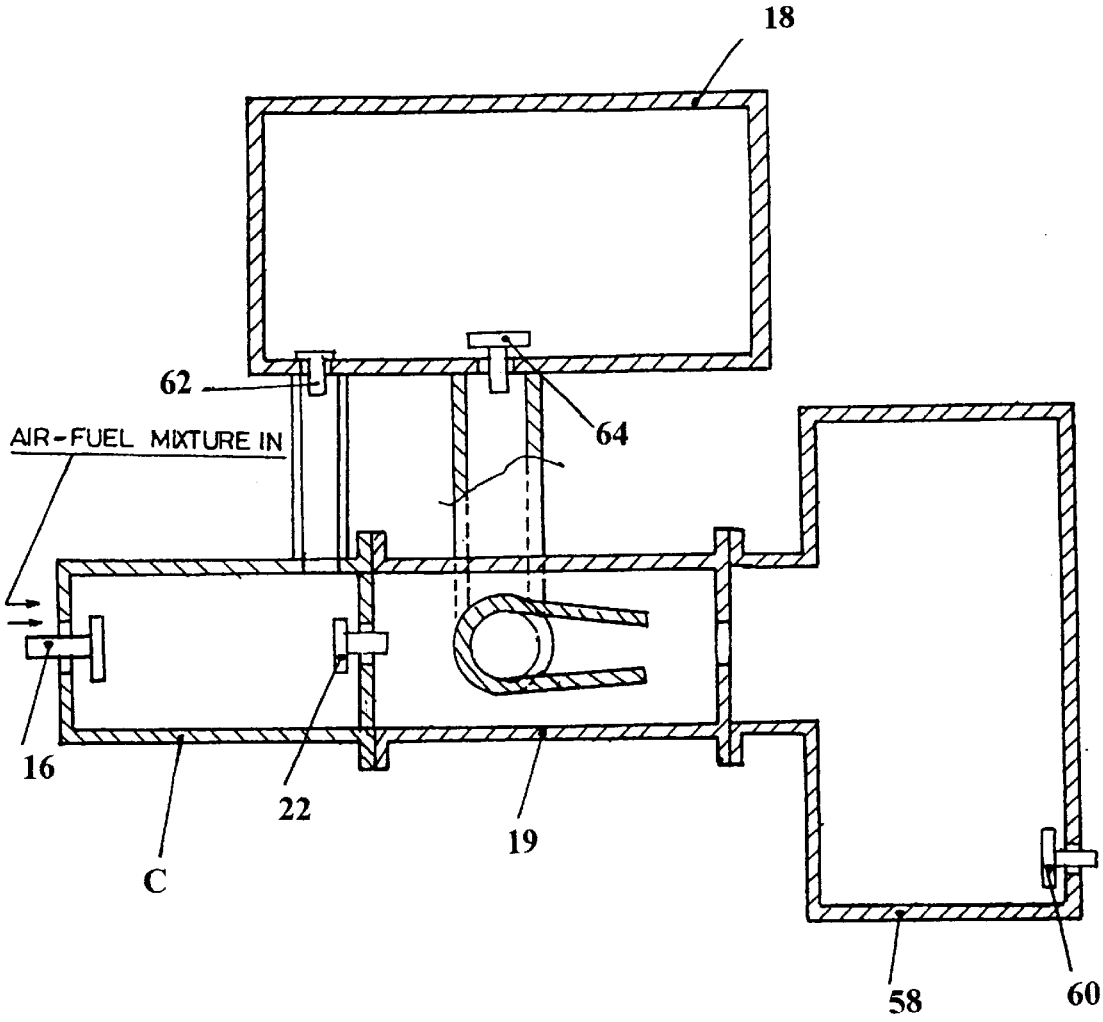
FIG. 12A shows another embodiment of the present invention, in the form of a high-pressure burnt gas generator.
Figure 12B:
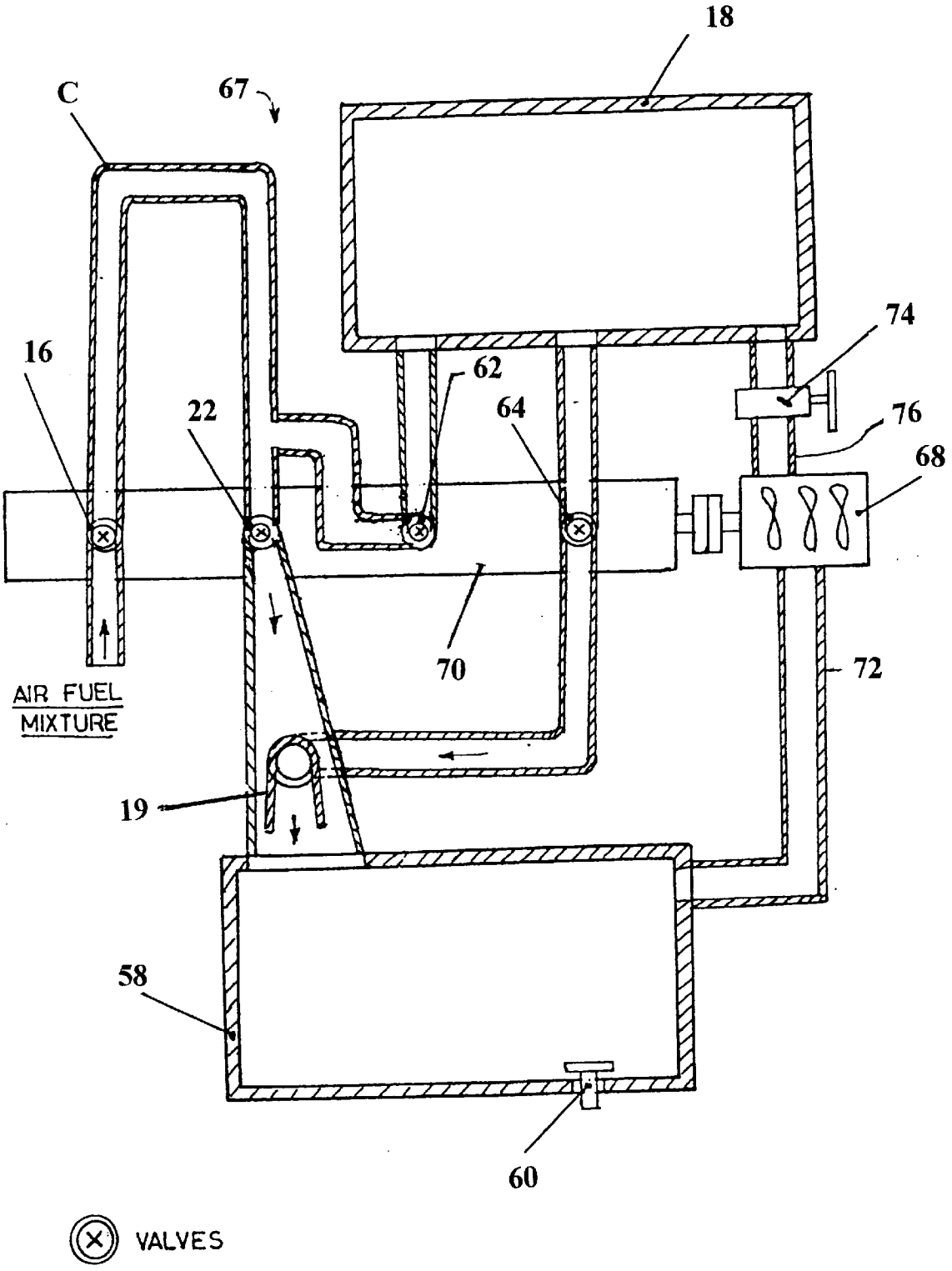
FIG. 12B shows another embodiment of the present invention, in the form of a high pressure burnt gas generator with self-starting arrangements.

Since it is possible to eliminate the solid piston, the shape of the closed chamber can be a mere bent pipe as shown in FIG. 12B, where the valves or ports can be combined into a single unit. It is only preferred to have the flowing path long and narrow, and the outer dimensions of the closed chamber cannot still be long and narrow. For example, the closed chamber can have partitions to achieve the desired result, similar to automobile exhaust silencers.

The closed chamber is strong enough to withstand the temperatures and pressures reached inside during various thermodynamic processes. The closed chamber can be finned at the outside or may have water or oil jackets for cooing purpose. Volume of the closed chamber is one of the deciding factors for the power capacity of the equipment as is the case in existing designs.

Figure 1:
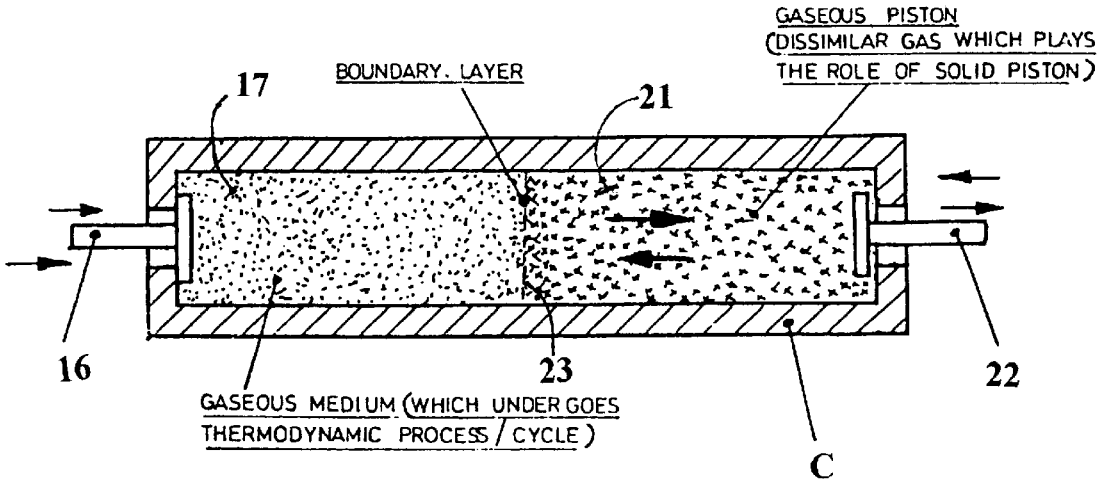
FIG. 1 shows the principle of a gaseous piston according to the present invention.

Basic principles of the gaseous piston according to the present invention are now discussed. Referring to FIG. 1, assume a gas 17 which is the medium undergoing thermodynamic process (called gaseous medium throughout) is trapped in a closed chamber C. Also assume a flowing gas 21, which is of different composition, is in direct contact with the gaseous medium 17 in the closed chamber C as shown in FIG. 1. The tendency of the flowing gas 21 is to increase the volume of the gaseous medium 17 as the flowing gas moves away from the gaseous medium. Similarly, the tendency of the flowing gas 21 is to decrease the volume of the gaseous medium 1 as the flowing gas moves towards the gaseous medium.

Hence, the flowing gas 21, which now acts as a gaseous piston, performs the suction or compression operation on the gaseous medium 17 as the flowing gas moves away from or towards the gaseous medium respectively, much similar to a solid piston. The mixing of the two gases is minimized to an acceptable level by making the flowing path of the closed chamber C long and narrow, (which reduces the area of the boundary layer 23 where the two gases meet) and if possible aerodynamic. Particular mention is made to the present day two-stroke engines, where, even though the flowing path is not quit long and narrow, the air-fuel mixture from the crankcase pushes the exhaust gases out of the closed chamber without appreciable mixing with it.

This present method of scavenging in two-stroke engines may in fact be called a gaseous piston aided by a solid piston for exhaust stroke (as it does not perform any suction and as the gaseous piston works on exhaust gas). This practical and successful case, where the two gases meet without appreciable mixing with each other, clearly shows that the present invention is also feasible and practicable. In those cases, if at all there is any, where even a small amount of dissimilar gas 21 mixing with gaseous medium 17 is not desirable, this gaseous piston method is not suitable. In this regard, even solid pistons do leak and allow the mixing of gases on either side of the piston to a small extent, which is negligible when the piston velocity is high.

It is to be noted that the gaseous piston does undergo pressure, volume and temperature changes as it does the suction or compression operation. But the gas discharge means is used or explained below, as the mode of creating and moving the gaseous piston in such a way that this change in state of the gaseous piston does not hinder the suction or compression operations in the actual case.

Figure 2:
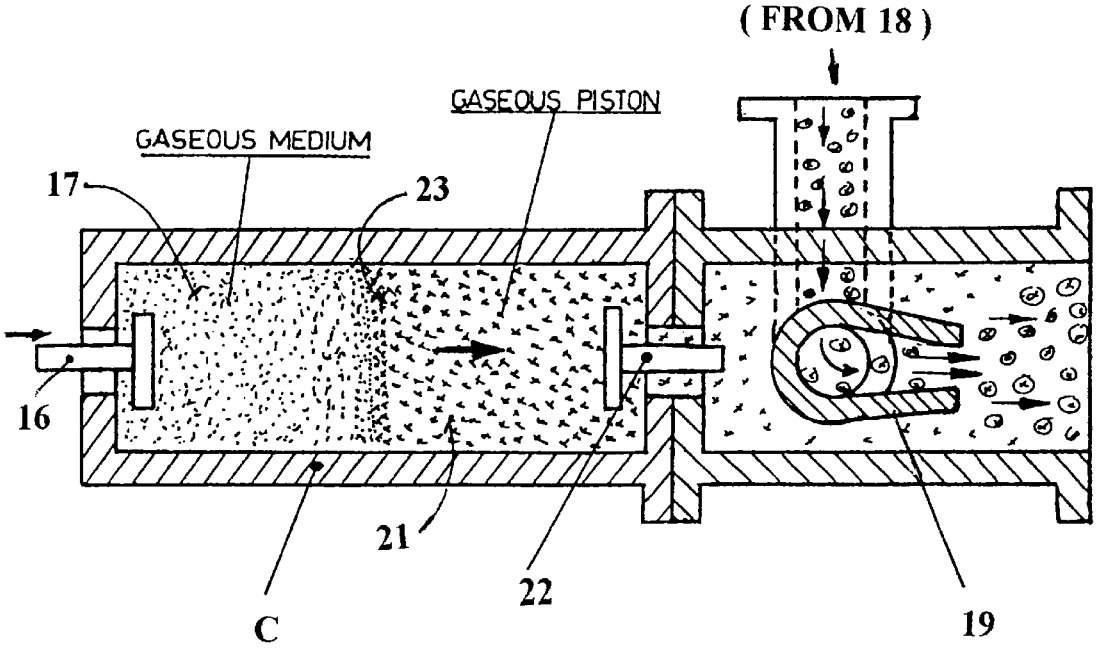
FIG. 2 shows a method and apparatus to generate gaseous piston for suction.

Please refer to FIG. 2 for a practical means of adopting the method. The closed chamber C in which suction is to be performed is connected to a venturi 19 in which flows any gas such that the suction in the venturi makes the dissimilar gas 21 already present in closed chamber C, to flow away from the gaseous medium 17. The away-flowing gas is directly in contact with the gaseous medium and sucks the gaseous medium as its tendency is to increase the volume of the gaseous medium.

The inlet and outlet valves 16 and 22 remain open in this case. The venturi 19 along with gas reservoir 18 (not shown in FIG. 2) make the gas discharge means here. Various shapes of venturi 19 which produce the suction necessary to create the away-flowing gas are shown in FIGS. 7 A, 7B, and 7C.

FIG. 3 illustrates the gaseous piston used for compression alone. The closed chamber which contains the gaseous medium is connected to a gas reservoir 18 functioning as a storage vessel which contains dissimilar gas at high pressure such that the high pressure gas is directly in contact with the gaseous medium in the closed chamber and compresses the gaseous medium by flowing towards it. The valve 20, which forms the discharge means along with gas reservoir 18, is open and inlet and outlet valves 16 and 22 remain closed in this case.

Turning to FIG. 4, the closed chamber C is connected with inlet valve or port 16 at one end. The other end of closed chamber C is connected to either gas reservoir 18 or venturi 19 or both, through a suitable valve or port 20. The gas reservoir 18, which forms part of the gas discharge means, generates gaseous piston for compression; and gaseous piston for suction with the aid of venturi 19. It is a vessel which is designed to withstand high pressure and temperature of the gas stored. There is no restriction on the shape of this vessel but the internal volume and the pressure set play important roles in the performance of the equipment.

The gas reservoir 18 is connected through valve 20 to closed chamber C (FIG. 3) or the venturi 19 (FIG. 4), or both as shown by various figures depending upon the requirement of gaseous piston.

The venturi 19, which also forms part of the gas discharge apparatus is a suitable element for generating gaseous piston for suction. The venturi is of rigid tubular structure which has at least two entries and one exit in such a way that when gas enters through one of the entries and flows through the exit, it causes suction at the other entry (or entries). The venturi mentioned herein covers any discharge device like a nozzle, orifice or even a combination of plain tubes which is designed to have plurality of entries and one exit for the gas, so as to give the above effect. The suction is achieved usually by decreasing cross-sectional area from the entry point to the throat of the venturi, which increases the velocity of flowing gas at the throat and decreases the pressure at the throat, as known to those skilled in the art.

Several shapes of venturi 19 which achieve the same effect are shown in FIGS. 7A, 7B, and 7C. One entry 23 of venturi is connected to closed chamber C and the other entry 24 is connected to the gas reservoir 18 via suitable valve or port 20, FIG. 4. In case a venturi with third entry is used, the third entry is connected to additional closed chamber C The external gas reservoir 18 is similar to C, but the volume is considerably high as it is a means of storing energy in the form of compressed gas for external use. The connectivity will depend on the application concerned details of which have been given in the individual devices mentioned below.

The inlet valve or port 16 for closed chamber C, is a usual valve or port which whenever opened, gives way for the gaseous medium to enter into the closed chamber C. The inlet valve or port 16 is connected on one side to the carburetor (not shown) in case the air-fuel mixture is to be sucked, or to an air-filter (not shown) in case air alone is to be sucked or an LPG vessel etc. The part to which vavle or port 16 is fixed depends on what the closed chamber is to be filled with. The other side of inlet valve/port is connected to closed chamber C.

The outlet valve or port 22 for closed chamber C is similar to conventional valve or port elements which, whenever opened, gives way for gas or air as the case may be, to exit from the closed chamber. The outlet valve or port 22 is connected to the closed chamber C on one side and to the venturi 19 on the other side (FIG. 2), if gaseous piston method is used for suction. The other side of the valve 22 is directly connected to exhaust (FIG. 3) if gaseous piston for suction is not used.

The other valves 20 and 28 are of similar function and are explained in the respective descriptions of disclosed embodiments. FIGS. 5, 6A, and 6B show typical valve and port structure suitable for use with the disclosed embodiments.

It is possible to have the valves or ports as a single unit, as shown in FIGS. 8A and 12B. One or more of the valves or ports may be one-way valves, one type of which is the reed valve (FIG. 8B), which allow gas through one direction only. Also, one or more of the valves may be more sophisticated pressure trap valves (FIG. 8C) which allow the gas to pass through, only if the pressure exceeds a set pressure. The valve or port operating mechanism is a conventional cam or eccentric mechanism or equivalent mechanical structure which operates one or more of the valves or ports.

The valve or port operating mechanism shown in FIG. 8A is connected on the input-side to a suitable drive and on the output-side to the valve or port assemblies 16, 20, 22, 28, etc. This may be one of mechanical drives such as direct coupling from the gas equipment concerned, or air-motor or equivalent or electro-mechanical such as solenoid operated drives, or electrical such as electric motor. The drive may in turn get its energy from the same gas equipment shaft or electric power source or, if it is a gas motor, may get gas supply from the same or different gas equipment.

Gaseous piston for both suction as well as compression operation in the same closed chamber is obtained by the following method. Please refer to FIG. 4 wherein the mechanisms shown in FIG. 2 and FIG. 3 are combined. The closed chamber C is connected to one of the two entries of venturi 19; the other entry of the venturi means being connected as before to the gas reservoir 18, through an intermediate valve 20. Whenever the gaseous piston for suction is desired, gas is admitted to flow through venturi 19, from gas reservoir 18, thereby creating an away-flowing gas from closed chamber C through the opening in the wall 24 separating first and second portions of the closed chamber C. Whenever the gaseous piston for compression is required, gas from gas reservoir 18 is let in to the closed chamber C, which may be again through the same venturi 19, while the inlet valve 16 and outlet valve 28 remain closed.

Note that in all three cases mentioned above, no solid moving parts like piston or rotors are used. The task is achieved by mere opening and closing of the valves. The gaseous piston is moved both ways merely by flow controls of gases, which is meant by gas discharge means. Although the principles of suction and compression caused by flowing gas and that of a venturi are fundamental, it is novel to use these as principal means of conducting the thermodynamic processes on a gas by another gas in a closed chamber, especially as a method of substitute for solid piston for suction and compression strokes.

The novelty of the invention and the fact that it is not obvious from any of the earlier methods is emphasized in the forthcoming unexpected new devices and their new and advantageous outputs. While it is possible to construct numerous closed chamber gas equipment using gaseous piston method with and without the combination of solid piston method, below are only a few embodiments of gas equipment which need not be of high precision and which are simple, of low weight, low cost but of high performance, flexible in performance and input requirement and handy.

Figure 9:
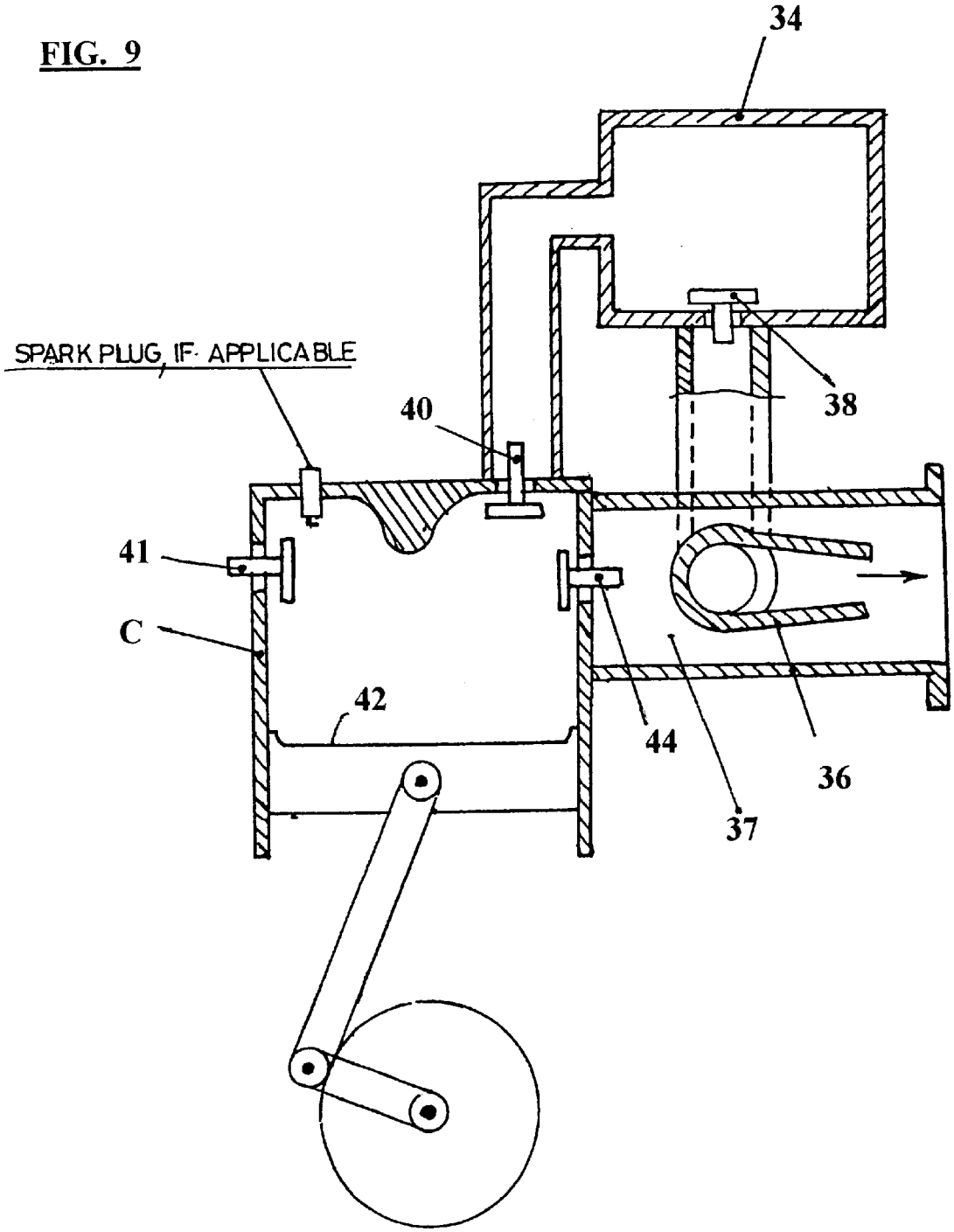
FIG. 9 shows an embodiment of the present invention, in the form of a two-stroke IC engine, where both gaseous and solid pistons are used and crankcase compression avoided.

FIG. 9 shows a two-stroke internal combustion engine using solid piston for compression and suction. This is a conventional two stroke IC engine modified to make use of gaseous piston for scavenging by suction but still retaining solid piston for compression and power strokes.

The engine, apart from its standard parts includes also the following parts:

- A gas reservoir 34, where burnt gas is stored at a set minimum pressure;
- A venturi 36 which can receive gas from cylinder C (closed chamber) and gas reservoir 34 in such a way that whenever gas flows from the gas reservoir through the venturi, it sucks gas from cylinder C through the open valve 44 connecting the cylinder to the venturi chamber 37 (34 and 36 make the gas discharge means in this embodiment);
- An outlet valve 38, connected to gas reservoir 34 which, whenever opened, lets out the gas from the gas reservoir to venturi 36, provided the pressure in the gas reservoir is greater than its set minimum value; and
- An intermediate valve 40 between the cylinder C and the gas reservoir 34 maintaining the minimum set pressure in the gas reservoir and otherwise allowing gas to pass in either direction through it.

Starting from the ignition point, the gas reservoir 34 is already charged to required minimum pressure. The solid piston 42 is at TDC (Top Dead Center), the fuel is already ignited, and pressure is increasing within the cylinder. The burnt gas charges the gas reservoir 34 beyond its set pressure through the now-open valve 40. But since the intermediate valve 40 allows the gas from gas reservoir 34 to the cylinder till the pressure in the gas reservoir falls down to its set pressure, the excess pressure of the burnt gas along with the gas in the cylinder pushes the solid piston down (power stroke). When the piston approaches the BDC (Bottom Dead Center), the outlet valve 44 is opened first and then the gas reservoir outlet valve 38 is also opened. This causes part of the gas in gas reservoir 34 to flow through venturi 36, which in turn causes suction in the cylinder C, creating an away-flowing gaseous piston and thereby scavenging the cylinder C by suction. The whole scavenging process is completed and all the valves closed before the piston has moved far from BDC. Hence the following upward movement of the piston is a compression stroke followed again by power stroke, which are the only two strokes in this engine, the scavenging operation consuming very little time and crank angle since they are performed by gaseous piston. Of course, the spark distributor (or the fuel injection pump as the case may be) and the cam shafts have to run at the same frequency as that of the crank shaft. This engine will have all the advantages of a two-stroke engine plus the following:

(i) Only one side of the piston is used; the crankcase side is free from port connections and pressures. Hence, crankcase design is simpler and cheaper and piston sealing is simpler.

(ii) The degree of scavenging is determined by design of venturi 36 and by the pressure and volume of the gas reservoir 34, whose pressure settings can be easily altered by the valve settings of intermediate valve 40. Hence, more complete scavenging and better combustion is obtainable with less air pollution and more power.

(iii) Longer power stroke possible as the scavenging duration can be reduced to lesser crank angle than solid piston method. Hence, more and better distributed power is produced.

(iv) The peak pressure reached immediately after the explosion is lower than what is attained in conventional engines as some pressure is lost to charge the gas reservoir C. But this loss of work is compensated as the solid piston does not have to compress the crankcase gas. The net result is reduced peak pressure and more uniformly-distributed pressures in each cycle.

Figure 10:
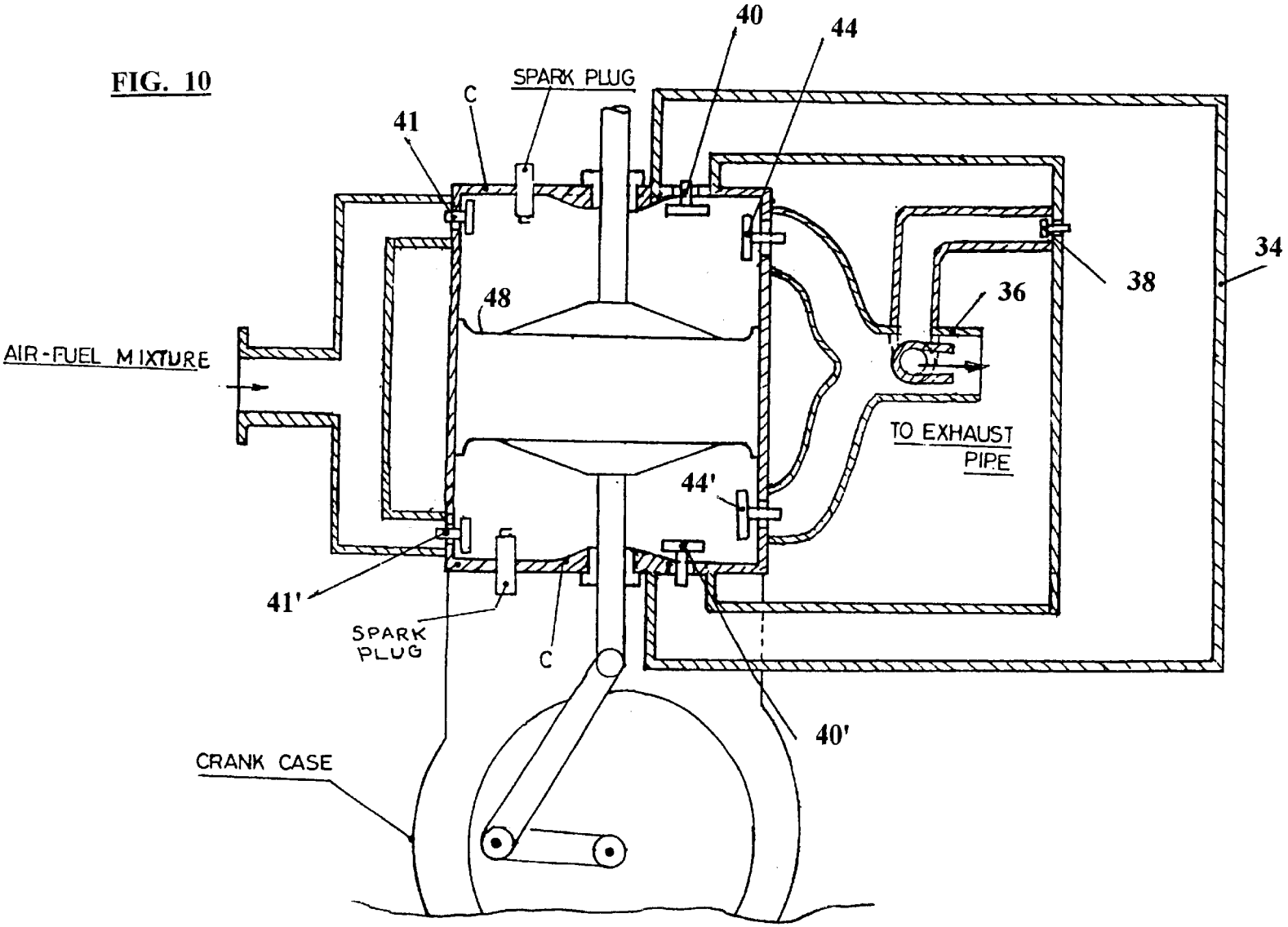
FIG. 10 shows another embodiment of the present invention, in the form of a one-stroke IC engine.

FIG. 10 shows a one-stroke IC engine using a solid piston and the gaseous piston. This IC engine with just one cylinder and one piston will deliver power for every one stroke of the piston. A one-stroke IC engine becomes a possibility because of the fact that two-stroke IC engine is possible using only one side of the solid piston as described above. Hence, one-stroke engine is a development from two-stroke gaseous piston engine, such that gaseous piston is employed at both sides of the solid piston alternately for suction.

In FIG. 10, the cylinder at the bottom side of the piston is closed and forms separate chamber C'. The additional inlet valve 41', outlet valves 44', and intermediate valve 40' are connected to the same main cylinder, but on the other side of the solid piston 48. (All parts designated by an apostrophe belong to the bottom closed chamber C'). The closed chambers C and C' on either side of the piston, are functionally the same and both are connected to the same gas reservoir 34, the same venturi 36, and same inlet and exhaust manifolds. As in the two-stroke engine of FIG. 9, the outlet valve 38 for gas reservoir 34 lets out gas from the gas reservoir through venturi 36. This generates gaseous piston for suction on that side of the piston for which the outlet valve 44 or 44' is opened.

Operation of the one-stroke IC engine is described starting from the suction at the top chamber C. The gas reservoir 34 is already charged to required minimum pressure, and solid piston 48 is at near BDC. Gaseous piston for suction is generated by opening valves 41, 44 and 38, and the top chamber C is scavenged and filled with air-fuel mixture and the valves are then closed. The solid piston 43 moves up, the air-fuel mixture is compressed and ignited, and the explosion is completed. The solid piston is now at near TDC. The intermediate valve 40' is opened and closed for a small interval of time and the gas reservoir 34 is charged with high pressure gas. The pressure at top closed chamber C falls to some extent, but enough to do external work and pushes the solid piston down. (Power stroke of top chamber C). While the solid piston is still close to TDC, the bottom chamber C' is scavenged by gaseous piston by opening the valves 41', 44' and 38, and hence, by the bottom chamber compression. The downward movement of solid piston 48 now is the power stroke for top chamber C and compression stroke for bottom chamber C'. Now, when the solid piston is at near BDC, the bottom chamber C' is ignited and pressure increases to its peak. The gas reservoir 34 is again charged by opening intermediate valve 40 and the remaining pressure of bottom chamber C' is used for the power stroke of bottom chamber C'. The whole cycle is again repeated, and the top chamber is again scavenged by suction as before while the solid piston is at BDC, by the gaseous piston. Hence, the upward movement of the solid piston is the power stroke of bottom chamber C' and compression stroke of top chamber C'. Each stroke of the solid piston thus is a power stroke on one side of the piston and compression stroke on the other side of the piston, the scavenging processes consuming little time and crank angle as it is done with gaseous piston by suction. Thus, the engine with single cylinder and single piston is capable of giving each stroke as power stroke, giving double the power of the two-stroke engine of almost the same size. Hence, this is a novel one-stroke engine.

The advantages set forth for present-day two-stoke engine over the present-day four-stroke engine apply as well for this one-stroke engine over two-stroke engine.

For almost the same sized cylinder and piston as compared to a conventional two-stroke engine, the one-engine generates double the power. Hence, power to weight ratio is doubled, and flywheel size is reduced (may not be practically required at all). The increase in cylinder length required to cater for the closed chamber on the other side of the piston is only that of clearance volume, as the swept volume is going to be common for the two chambers C and C'.

Apart from the above, the advantages mentioned above for the two-stroke engine of FIG. 9 are valid for this engine as well. Also, the average pressure difference between the two sides of the piston is reduced, as it is always power stroke on one side and compression stroke on the other side. Moreover, this compression stroke on one side of the piston can be designated as compression until ignition, which is much more severe than the crankcase compression of air-fuel mixture in conventional two-stroke engine. Hence, the piston is better balanced and the engine runs smoother.

Figure 11:
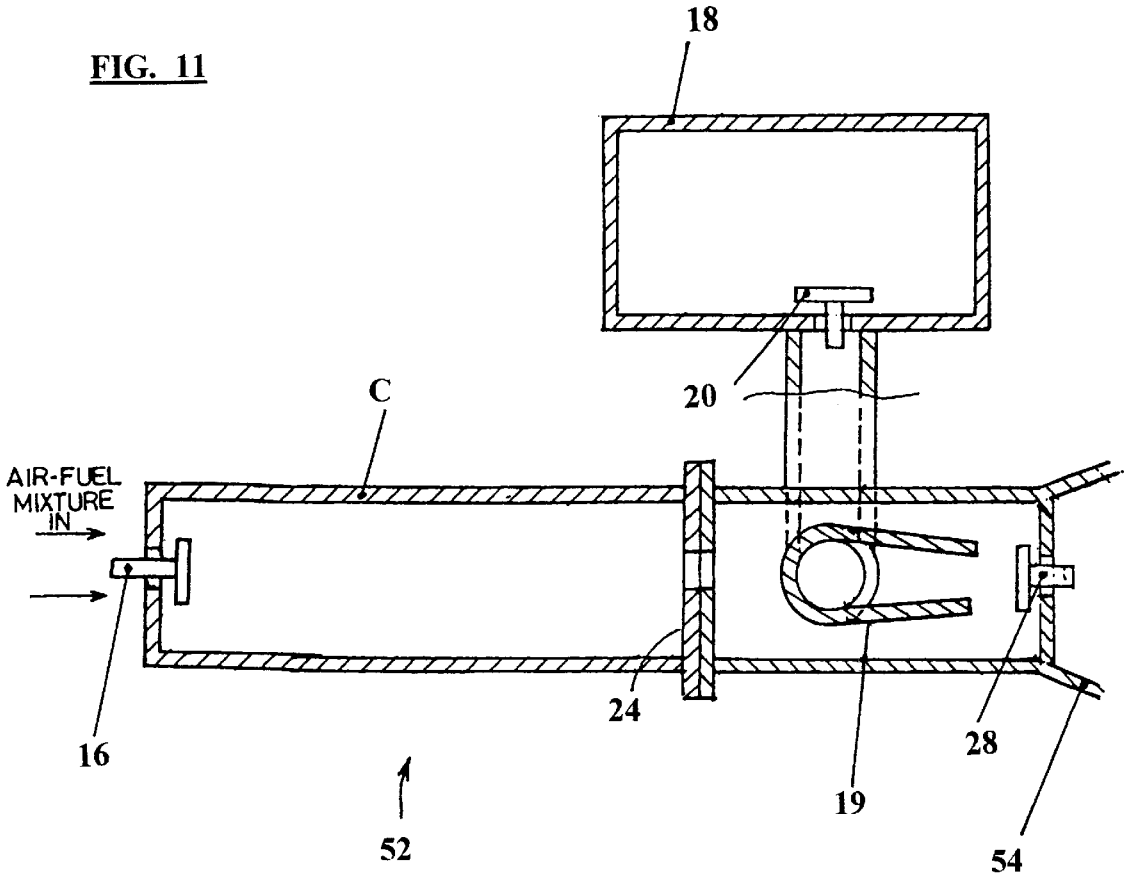
FIG. 11 shows another embodiment of the present invention, in the form of a closed chamber intermittent jet engine using only gaseous piston.

FIG. 11 shows a closed chamber intermittent jet engine using gaseous piston for both suction as well as compression. This engine draws, compresses and explodes air-fuel mixture similar to an IC engine, but solely with gaseous piston, not using any solid piston or rotors, and delivers an intermittent jet of burnt gas as its mode of power output.

As is apparent from FIG. 11, the engine comprises all the parts mentioned with reference to FIG. 4, gaseous piston method for suction as well compression strokes and the assembly is done as in that embodiment and as here described. The closed-chamber C and the gas reservoir 18 are connected to the two entries of the venturi 19. The outlet valve 28 of the closed chamber C, inlet valve 16 for closed chamber C, and the intermediate valve 20 for gas reservoir 18 are operated by valve actuating mechanism of the kind shown in FIG. 8A. The intermediate valve 20 is a pressure trap valve means which maintains a pre-determined minimum pressure in reservoir 18 and otherwise allows gas either way through the intermediate valve.

For initial conditions to start the engine shown in FIG. 11, the gas reservoir 18 is kept at the required minimum pressure. This minimum pressure is that sufficient to do the following: stroke 1, scavenging by suction, and stroke 2, compression and explosion, followed by a third stroke for delivering power.

In stroke 1, the intermediate valve 20 for gas reservoir 18 and the inlet and outlet valves 16 and 28 for closed chamber C, are kept open simultaneously for a definite period and then closed. This causes high pressure gas from the gas reservoir 18 to flow through the venturi 19, which, in turn, causes away-flowing gaseous piston at the closed chamber C and hence, air-fuel mixture is sucked into the closed chamber C through the inlet valve 16. The burnt gas already present in the closed-chamber C acts as the gaseous piston and leaves through the venturi 19.

Stroke 2, compression and explosion, occurs after stroke 1. The intermediate valve 20 between closed-chamber C and gas reservoir 18 is opened for a definite short period and then closed, during which time, the high pressure gas from the gas reservoir enters the closed-chamber C, directly compressing the air or air-fuel mixture (refer also to FIG. 3) and igniting it, the ignition mode being either compression-ignition or spark-ignition. (The mode of ignition is not shown in FIG. 11.) The ignited gas in the closed chamber C explodes, causing the pressure in both the closed chamber and the gas reservoir 18 to shoot up beyond the set minimum pressure of the gas reservoir. The disadvantages of pre-ignition and knocking in present day IC engines are not applicable here, because the timing of ignition does not affect the performance of the equipment as there is no solid piston involved. The explosion takes place in a completely sealed vessel; noise and vibration are suppressed. There is no solid moving piston inside to cause leakage or force imbalance or loss of power.

("Compression ignition" here means either (a) the air alone is drawn, compressed and fuel injected into the closed chamber C, or (b) air-fuel mixture is drawn and compressed till ignition.)

Since the ignition timing is not important when a solid piston is not used, using the process (b) eliminates the fuel injection pump as well as the spark plug. The compression ratio mainly depends on the pressure set in the gas reservoir 18 and the volumes of the closed chamber C and the gas reservoir 18. The intermediate valve 20 between closed chamber C and gas reservoir 18 may be a spring loaded pressure trap valve (FIG. 8C), which decides the pressure set in the gas reservoir and the compression ratio. Hence, compression ratio is an easily alterable one here. For the machine to be capable of delivering power, the theoretical required condition is that the heat delivered by the fuel per cycle should be much more than the adiabatic work done during compression. This can be proved to be easily attainable.

Of course, the efficiency of the machine lies in how effectively the heat delivered is converted into external work, or "mode of power output". Since more conversion of heat to work is obtained by higher compression ratio (and thereby the higher explosion pressure), this engine scores high marks easily as the compression ratio is easily alterable.

The gas coming from the gas reservoir 18 does not mix appreciably with air-fuel mixture in the closed chamber C by having the closed chamber C long and narrow. Note that there is no restriction to the geometry of the closed chamber in this device. Hence, the air-fuel mixture is retained at sufficient richness to get ignited and acceptable fuel-economy and efficiency is obtained.

In Stroke 3, power delivery, the outlet valve 28 is opened till pressure in the closed chamber C falls to minimum. The burnt gas in the closed chamber C and the excess gas stored in the gas reservoir 18 both are let out through the venturi 19 and then through a nozzle 54, if necessary. The pressure in the closed chamber C falls to atmospheric pressure if the venturi 19 is open to atmosphere, in which case pressure in the gas reservoir 18 falls back to its set pressure, the pressure being trapped by the intermediate valve 20. Hence, with no piston or precisely machined cylinder or rotors, power is obtained in the form of a jet of burnt gas from the venturi 19 and/or nozzle 54 which can be used in conventional methods. The above three strokes are repeated again and again by the appropriate valve operating mechanism.

The three strokes described here do not consume equal amounts of time as is almost the case of solid piston devices. The compression stroke consumes just a small fraction of that taken by the suction stroke. The power stroke also takes lesser time than the suction stroke. In fact, the ratio of duration of each stroke is left to the designer's discretion, which is impossible in the solid piston method. The suction and compression speeds are very high compared to that of a solid piston engine because they are done by gaseous piston.

The engine 52 being a completely gaseous piston engine, derives the following advantages as compared with a solid piston engine, of equal volume of closed chamber C:

- Multiple mode of Power; delivers power in the form of intermittent jets, so that (i) it can be directly used as a jet engine, or (ii) it can be made to run a turbine, or (iii) it can be used to store high pressure gas from which energy can be tapped in conventional methods—which has got its own advantages (Please refer below to the description of the embodiment in FIG. 12A.)
- The compression ratio can be varied by simple valve settings. Hence, using alternate fuels in the same engine is possible.
- No ignition timing arrangement (spark distribution or cam arrangement for fuel injection) is required.
- Problems like knocking, pre-ignition, etc., which are caused by ignition timing, are not applicable in this engine.
- Igniting devices not required. Neither a spark plug with ignition coil nor fuel injection pump is required, since any combustible mixture can be compression ignited.
- High power-generating capacity when compared to an equal volume of an IC engine, as the speed of gaseous piston is much higher compared to that of a solid piston.
- No heavy starter motor and starting gear. Operating a valve mechanism needs much lower power compared to cranking a piston in a cylinder. Alternatively, the stored exhaust gas itself can be used to run the valve mechanisms which eliminates the starting motor. (Please refer below with regard to FIG. 12B.)
- Vibration is reduced, with no solid reciprocating parts.
- Friction loss is reduced, with no sliding parts.
- Lubrication is simple since it is required only for valves or ports.
- Low weight of the engine.
- Cooling system is simple since the hot closed chamber is long. Moreover, the closed chamber can work at much higher temperature since there are no sliding parts.

Hence only valve mechanisms need to be maintained at low temperature. Thermal efficiency is increased since the working temperature is high (Carnot efficiency) and less heat is lost in cooling system.

Ease of manufacture: Number of precision parts are less. No piston, no machined cylinder, no piston rings.

Carburetor design is simple, because power demand fluctuations are low.

Costs far less for the same power due to all the above points.

Possible to have the power far less dependant on the output speed by using reciprocating gas motor operated by stored high pressure burnt gas.

FIG. 12A shows a high pressure burnt gas generator embodying the present invention. This device is an extension of the gaseous piston intermittent jet engine described above with respect to FIG. 11 such that the intermittent jets of burnt gases are stored in an external gas reservoir 58 from where power can be tapped in conventional methods.

Apart from the parts shown in FIG. 11 and identified with common reference numerals, this device comprises an external gas reservoir 58 connected to the venturi 19, and an outlet valve 60 for the external gas reservoir to tap high pressure gas for external work. Also inlet valve 62 and outlet valve 64 for gas reservoir 58 are used independently as shown in FIG. 12A. Outlet valve 22 for closed chamber C is added, while the outlet valve 28 (FIG. 11) for the chamber is removed.

FIG. 12B shows generally at 67 an engine having a high pressure gas generator with self-starting arrangement using an optional gas motor 68 which drives the valve actuating ,mechanism 70 by getting high pressure gas from gas reservoir 18 itself as its input energy. Both arrangements above may have the venturi means 19 to end with an additional discharge means so as to convert the high-velocity low-pressure jet into a low velocity high pressure one.

Gaseous piston for suction and compression are alternatively created by first opening valves 16, 22 and 64 for a short time (suction), and then opening only 62 (compression and explosion). Output jet power is released by opening valve 22, and the cycle is repeated continuously by the valve actuating mechanism 70, which is operated by gas motor 68. The energy required by gas motor 68 is very low, as it operates only the valves.

The pressure in external gas reservoir 58 keeps increasing after each issue of jet from the venturi 19.

The burnt gas flows as a jet from the closed chamber C to external gas reservoir 58, only if the pressure difference between the closed chamber and C the external gas reservoir is considerably high. Also, the extent of the suction caused by the venturi is high only when this pressure difference is high. After a certain time, since the pressure difference keeps falling and hence the amount of intake air-fuel mixture is also reducing, there is not enough air-fuel mixture to burn in the closed chamber C and hence no further build-up of pressure in external gas reservoir 58.

Also, the outlet 72 of gas motor 68 is connected to external gas reservoir 58 and since the pressure in the external gas reservoir is increasing, after a certain time the gas motor stops because there is no pressure difference between the pressure set in pressure regulator 74, in the line 76 from the gas reservoir 18 to the gas motor, and the external gas reservoir. Hence by either or both of the above methods the engine automatically stops after charging external gas reservoir 58. If power is taken from external gas reservoir 58 using valve 60, the engine starts running again as the pressure in external gas reservoir 58 falls and the gas motor 68 is activated and more air-fuel mixture is drawn. The gas motor 68 and the pressure regulator 74 can be replaced by electric motor, or the valves can be solenoid-operated valves with pressure sensing valves, which are left to the discretion of the designers.

The engine 67, being a completely gaseous piston engine, derives all the advantages mentioned for the closed chamber intermittent jet engine of FIG. 11 as well as the following advantages:

1. Multiple modes of Power; it stores energy in the form of high pressure burnt gas, so that it can generate a more uniform jet with appropriate nozzle arrangement for use as a jet engine, to run a turbine, to run conventional gas motors (reciprocating or rotary)
2. Can deliver power from zero R.P.M. of the output shaft similar to a steam engine. Hence, eliminates gear box, clutch system, etc.
3. Smooth power transmission similar to a steam engine.
4. No idling speed and wastage of fuel. Auto-switching off and auto start.
5. Power transmission is easier since it can be transmitted through pipes.

Figure 13:
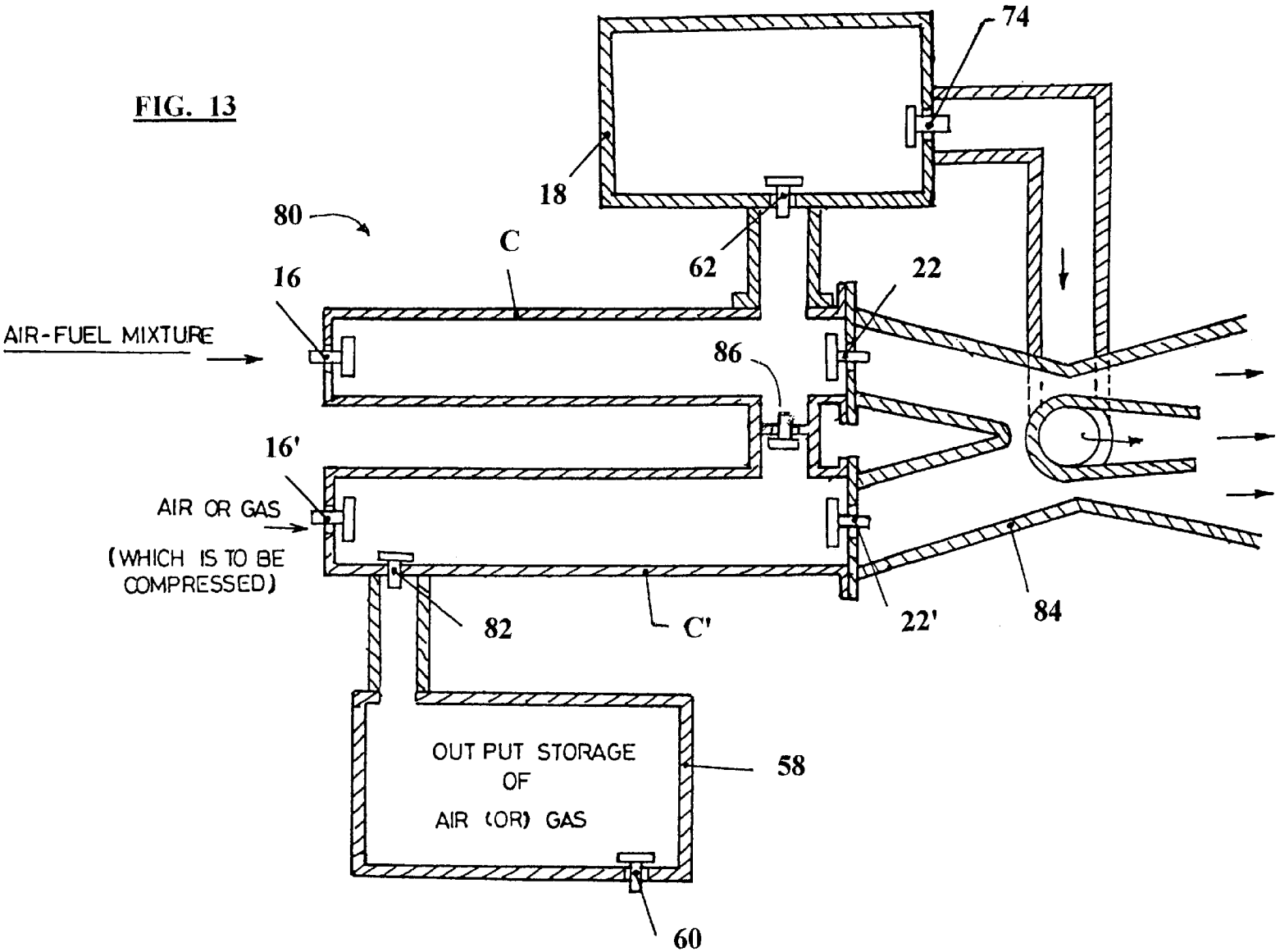
FIG. 13 shows another embodiment of the present invention, in the form of a reciprocating compressor using only gaseous piston, providing a reciprocating compressor with no solid piston and driven by the apparatus shown in FIG. 11.

FIG. 13 shows a gaseous piston reciprocating compressor 80 driven by gaseous piston intermittent jet engine as in FIG. 11. Compressor 80 is a closed chamber reciprocating air compressor which makes use of gaseous piston method in place of solid piston method, getting its power from a liquid or gaseous fuel.

It is an assembly of two gaseous piston gas equipments, namely, a reciprocating air compressor, and intermittent jet engine (as in FIG. 11), in such a way that the explosion of gas in gaseous piston engine causes direct compression of air (or another gas) in another closed chamber C'. The engine and the compressors are made a single assembly and both do not use solid piston.

Referring to FIG. 13, the compressor 80 comprises gaseous piston-closed chamber-intermittent jet engine 52 show in FIG. 11 and identified by common reference numerals, and the following additional parts:

An additional closed chamber C' for compressing a desired air or gas;

Inlet valve 16' and outlet valve 22' for the additional closed chamber C'; and An external reservoir 58 for storing compressed air/gas which is meant for the user. This is similar to the air-vessel of present-day reciprocating air compressors. Inlet valve 82 and outlet valve 60 are provided for the external reservoir 58. An additional valve 86 near the outlet of closed chamber C selectively connect closed chambers C and C'.

The venturi 84 has an inlet connected to gas reservoir 18 through valve 74, and one exit. Inlet lines extend from the venturi throat to the closed chamber C and to the additional closed chamber C'. The venturi inlet lines are connected at the respective valves 22 and 22', so that whenever gas flows from gas reservoir 18 through valve 74 to the venturi 84, it causes suction at both the closed chambers C and C' simultaneously, thereby generating outgoing gaseous piston in both the closed chambers.

The gas reservoir 18 is also meant for generating gaseous piston for compression in closed chamber C. The two closed chambers are connected at the outer end by additional valve 22, which may again be a pressure trap valve and which when opened, lets the gas from closed chamber C1 flow to additional closed chamber C'.

Valves 16, 16', 22, 22' and 74 are opened for a short time and then closed. This allows the stored burnt gas in gas reservoir 18 to flow through venturi 84, thereby creating suction at closed chambers C and C' simultaneously. Hence air is taken into C' and air-fuel mixture is taken into C.

Compression and explosion occurs as the intermediate valve 62 is opened for a short time and then closed. This compresses the air-fuel mixture and ignites it to cause explosion, which recharges the gas reservoir 18. Now high-pressure burnt gas is stored in combustion chamber C.

For air compression, valves 82 and 22 are opened for a short while and then closed. This causes the burnt gas from combustion chamber C to directly compress the air in compression chamber C' and push it into external reservoir 58. Burnt gas is the gaseous piston here.

Again, the mixing of the air and burnt gas can be kept to the minimum by designing the L/D ratio of the closed chamber C' high enough, and streamlining the bore of the chamber C'.

The above processes are repeated continuously to draw and compress the air into the air vessel.

All the advantages of gaseous piston over solid piston, stated above, are applicable to this compressor 80. The rate at which this device compresses is much higher than the reciprocating compressor with solid piston, as the velocity of gaseous piston is much higher than that of solid piston. This device eliminates a separate engine and several conventional parts like, solid piston, piston rod, crankshaft, crankcase, etc. The only moving parts here are the valves and the valve actuating means, which are relatively much easier to maintain. The valves and the valve actuating means are the only parts that need precise machining.

Figure 14:
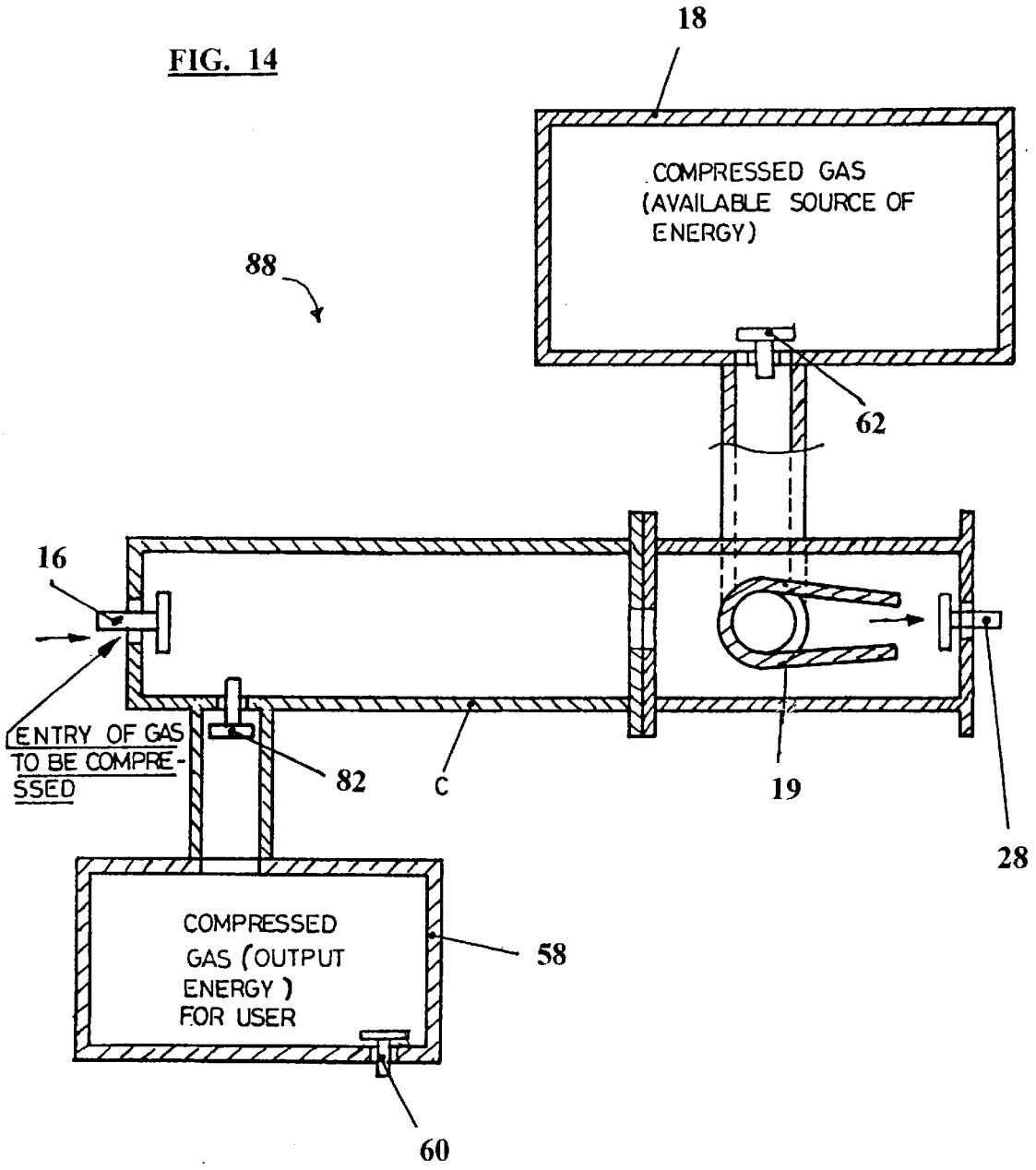
FIG. 14 shows another embodiment of the present invention, in the form of a reciprocating compressor using only gaseous piston, providing a scheme of reciprocating compressor driven by another compressed gas.

FIG. 14 shows generally at 88 a gaseous piston reciprocating compressor driven by another compressed gas. There are situations where high pressure gas is available but we require only high pressure air is required. For example, in a steam plant or railway steam engine, high pressure, high temperature steam is available, but at the same time high pressure air is required for the air-brakes and for the air conditioners, air blowers, and for pneumatic equipment. In gas storage units, where special-purpose gases are to be bottled separately, compressed air may be available but people are using separate solid-piston reciprocating compressors driven by electric motors for compressing the gases. In hazardous gas atmospheres like oil refineries, gas stations and LPG storage, bottling and distribution centers, it is safe and cost effective to use non-electric compressors and avoid spark creators instead of adding flame proof electric devices and intrinsically safe electric/electronic circuits. Note that the apparatus shown in FIGS. 11, 12A, 13 and 14 herein can all be made fully non-electric.

An energy source in the form of a compressed air or gas as disclosed above can compress air (or another gas) by using the equipment 88. This equipment comprises all the parts mentioned with regard to FIG. 11, viz., the closed chamber gaseous piston intermittent jet engine, and also includes an external reservoir 58 to collect the air or gas being compressed by this equipment. The gas reservoir 18 in this case is actually the available energy source which contains an already compressed gas. The inlet valve 82 (for example, a reed valve as in FIG. 8B) for external reservoir 58, opens whenever pressure in C is greater than pressure in the external reservoir. Outlet valve 60 connects to the external gas reservoir 58 for extracting the compressed air or gas from the external gas reservoir.

To compress air with the available source of energy being a compressed gas at 18, assume initially the closed chamber C is filled with air. Compression occurs when valve 62 alone is opened and closed for a small and precise interval of time. During this small interval of time, the high pressure gas from gas reservoir 18 rushes into the closed chamber C acting as gaseous piston and compressing the air inside C. The compressed air enters the air vessel (external reservoir 58), opening the valve 82.

Suction then occurs as the intermediate valve 62, the outlet valve 28, and inlet valve 16 are opened for some time and then closed. This scavenges the closed chamber C by the suction caused by the venturi 19 by letting the gas from gas reservoir 18 out through valve 28, creating the away-flowing gaseous piston in closed chamber so that the closed chamber is again filled with air.

In this apparatus 88, valves 16 and 82 are one-way valves which open and close automatically by differential pressures, such as reed valves described above. Hence, the only valves to be actuated at all are the outlet valve 28 and intermediate valve 62, whose speed and frequency are determined by the volume of the closed chamber C, the pressure set in the gas reservoir 18, and the flow resistances offered by the valves.

As said earlier, the gaseous piston does not mix appreciably with the air being compressed because of the sufficiently high L/D ratio and the shape of the closed chamber C. The two strokes are repeated continuously by suitable valve actuating mechanism (not shown in FIG. 14).

Apart from overcoming the problems due to solid piston method mentioned above, the compression equipment 88 has the following advantages:

i. The rate at which the vessel 58 is getting charged is much higher than that of a solid piston type reciprocating compressor, as the velocity of gaseous piston is much higher than that of the solid piston.

ii. A separate electric motor and a solid piston reciprocating compressor is eliminated, by using this gaseous piston reciprocating compressor.

It should be evident that the gaseous piston method for suction and compression in closed chamber gas equipment is technically feasible as mentioned hereinabove. Any device that employs a solid piston in a closed chamber for performing suction or compression can be equivalently replaced or modified to make use of gaseous piston method. Hence, the advantages are numerous depending on the device concerned.

Also, the gaseous piston method gives birth to new devices such as one-stroke Engine, reciprocating compressor integral with IC Engines, intermittent jet engine, high pressure burnt gas generator, etc.

With the basic application of the invention remaining same, the schemes of new devices mentioned here can be easily altered by skilled engineers into even simpler forms and give the same results.

The nature of this invention is so basic that it will create innumerable new devices in future which will save lot of precious human time and energy and will lead to a better life.

The advantages said above and the extraordinary new devices make it clear that the invention after all is not obvious from any of prior art. In particular, the process of U.S. Pat. No. 585,434 (mentioned above) is distinctly opposite. In the present invention, the process is suction for filling up the closed chamber with gaseous medium, whereas in that patent it is compression (slight increase in pressure of exhaust gases caused due to resistance to flow) performed for the same.

The method adopted in the present invention is superior. It is not possible to convert the prior-art engine into a double acting engine. In other words, a one-stroke engine is not possible with the '434 patent, which though seemingly using a gaseous piston for scavenging, is in fact aided by a solid piston. The air-fuel mixture which may be called the gaseous piston in the patent is in fact generated due to the compression by the solid piston in the crankcase. An exhaust port is opened before the solid piston reaches the bottom dead center and hence the solid piston still keeps pushing the burnt gases indirectly by pushing the air-fuel mixture in the crank case. That is, the solid piston acts together with gaseous piston for the same operation. In the present invention the suction or compression, if done by gaseous piston is unaided by any solid moving parts and is solely done by gas discharge device.

It should be understood that the foregoing relates to preferred embodiments of my invention, and that numerous changes and modifications therein may be made without departing from the spirit or scope of the invention as defined in the following claims.

I claim:

1. A method of inducting and compressing a gaseous medium, comprising:

providing a closed elongate chamber having a first end and a second end and permiting gaeous fluid flow between the ends, and having an inlet valve selectively operable to admit a fuel/air gaseous medium adjacent the first end of the chamber and an outlet valve adjacent the second end of the chamber;

performing induction by opening the inlet and outlet valves while admitting to the chamber a flow of a gas dissimilar to the fuel/air medium and operative to exit the chamber while reducing pressure within the chamber, whereby the reduction in pressure inducts the fuel/air medium through the open inlet valve into the chamber;

closing the inlet and outlet valves after an amount of the fuel/air medium enters the chamber;

performing compression of the inducted medium by continuing the inflow of the dissimilar gas at a pressure greater than the pressure of the fuel/air medium in the chamber, so that the inflow of dissimilar gas into the chamber compresses the fuel/air mixture, thereby performing the function of a piston within the chamber;

detonating the fuel/air mixture in the chamber; and then opening the outlet valve to allow expanding gas from the detonation to exit the chamber for performing work.

2. The method as in claim 1, wherein the step of detonation comprises:

compressing the fuel/air medium by the dissimilar gas until the fuel/air mixture detonates.

3. The method as in claim 1, further comprising:

providing a storing vessel selectively connectable to the chamber for supplying the dissimilar gas at high pressure to the chamber; and using the expanding gas of detonation as a piston to return the dissimilar gas to the storage vessel at high pressure, so as to provide a supply of the dissimilar gas at high pressure for a subsequent compression in the chamber.

4. The method as in claim 3, further comprising:

providing a third valve between the chamber and the storage vessel;

opening the third valve to accomplish the step of admitting high-pressure dissimilar medium to the storage vessel; and closing the third valve after the expanding detonation gas returns the dissimilar gas to the storage vessel, thereby recharging the storage vessel with pressurized dissimilar gas for a subsequent cycle of operation.

5. The method as in claim 1, wherein the dissimilar gas flows through a venturi operative to cause the reduction in presure within the chamber.

6. The method as in claim 2, wherein:

the gaseous medium admitted to the chamber is air; and fuel is added to the compressed gaseous medium to form a combustible fuel/air mixture within the chamber.

7. A method of inducting and compressing a gaseous medium, comprising:

providing an elongate chamber having an inlet valve selectively operable to admit a gaseous medium at a first end of the chamber and an outlet valve at a second end of the chamber remote from the first end;

opening the inlet valve to admit a supply of the gaseous medium to the chamber at the first end, and then closing the inlet valve; and admitting to the chamber adjacent the second end a flow of a gas dissimilar to the gaseous medium and at high pressure, relative to the pressure of the gaseous medium within the chamber, so that the dissimilar gas flows toward the first end of the chamber and thereby acts as a piston to compress the gaseous medium admitted to the chamber.

8. The method as in claim 7, further comprising:

expanding the gaseous medium in the chamber after the step of compression; and opening the outlet valve to allow the expanding gas to exit the chamber for performing work.

9. The method as in claim 8, wherein:

the gaseous medium within the chamber is a fuel/air mixture; and further comprising combusting the compressed fuel/air mixture within the chamber so as to expand and function like a piston to perform work on the dissimilar gas within the chamber.

10. A method of inducting a gaseous medium, comprising:

providing a closed elongate chamber having a first end and a second end, and permiting gaseous fluid flow between the ends, and having an inlet valve selectively operable to admit a gaseous medium adjacent the first end of the chamber and an outlet valve adjacent the second end of the chamber;

performing induction by opening the inlet and outlet valves while admitting to the chamber a flow of a gas dissimilar to the medium and operative to exit the chamber while reducing pressure within the chamber, whereby the reduction in pressure inducts the medium through the open inlet valve into the chamber; and then closing the inlet and outlet valves after an amount of the medium enters the chamber.

11. Apparatus for compressing a gaseous medium, comprising:

a closed elongated chamber having first and second ends and operative to permit gaseous fluid flow between the ends of the chamber;

an inlet valve selectively operable to admit a gaseous medium adjacent the first end of the chamber;

an outlet port having an outlet valve adjacent the second end of the chamber;

a storage vessel in communication with the chamber through a third valve selectively operable to supply to the chamber a gas dissimilar to the gaseous medium and at a high pressure relative to the pressure of the gaseous medium in the chamber;

a venturi operatively associated with the chamber and producing a reduced fluid pressure adjacent the second end of the chamber in response to the dissimilar gas entering the chamber from the storage vessel;

means opening the inlet, outlet, and third valves so that the dissimilar gas flows through the venturi and exits the chamber so as to reduce the pressure within the chamber, whereby the reduced pressure inducts the gaseous medium into the chamber through the open inlet valve;

means closing the inlet and outlet valves after a predetermined amount of the gaseous medium enters the chamber, while continuing the inflow of the dissimilar gas at a pressure greater than the pressure of the gaseous medium in the first chamber, so that the dissimilar gas compresses the gaseous medium in the chamber, thereby performing the function of a piston within the chamber; and means selectively opening the second valve for removing the compressed gaseous mixture from the chamber.

12. Apparatus as in claim 11 wherein the gaseous medium inducted to the chamber is a fuel/air mixture and that mixture is detonated in the chamber, and further comprising:

means operative to open the third valve after detonation so that the expanding gas of detonation functions like a piston to return the dissimilar gas to the storage vessel at a high pressure, thereby providing a supply of the dissimilar gas at the relatively high pressure for a subsequent cycle of operation of the apparatus.

13. Apparatus for inducting a gaseous medium, comprising:

a closed elongated chamber having first and second ends and operative to permit gaseous fluid flow between the ends of the chamber;

an inlet valve selectively operable to admit a gaseous medium adjacent the first end of the chamber;

an outlet port having an outlet valve adjacent the second end of the chamber;

a storage vessel in communication with the chamber through a third valve selectively operable to supply to the chamber a gas dissimilar to the gaseous medium and at a high pressure relative to the pressure of the gaseous medium in the chamber;

a venturi operatively associated with the chamber and producing a reduced fluid pressure adjacent the second end of the chamber in response to the dissimilar gas entering the chamber from the storage vessel;

means opening the inlet, outlet, and third valves so that the dissimilar gas flows through the venturi and exits the chamber so as to reduce the pressure within the chamber, whereby the reduced pressure inducts the gaseous medium into the chamber through the open inlet valve; and means closing the inlet and outlet valves after a predetermined amount of the gaseous medium enters the chamber, so that the dissimilar gas inducts the gaseous medium in the chamber and thereby performs the function of a piston within the chamber.

* * * * *